US008647151B2

(12) United States Patent
Ikegami et al.

(10) Patent No.: US 8,647,151 B2
(45) Date of Patent: Feb. 11, 2014

(54) CONTACT UNIT AND PRINTED CIRCUIT BOARD CONNECTOR HAVING THE SAME

(75) Inventors: Fumihito Ikegami, Tokyo (JP); Hiroaki Kukita, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 59 days.

(21) Appl. No.: 13/489,841

(22) Filed: Jun. 6, 2012

(65) Prior Publication Data

US 2013/0005165 A1 Jan. 3, 2013

(30) Foreign Application Priority Data

Jul. 1, 2011 (JP) ..... 2011-147319

(51) Int. Cl.
*H01R 13/648* (2006.01)

(52) U.S. Cl.
USPC ..... 439/607.35; 439/607.07

(58) Field of Classification Search
USPC ..... 439/607.35, 607.07, 74, 108, 941
See application file for complete search history.

(56) References Cited

U.S. PATENT DOCUMENTS 4,846,727 A * 7/1989 Glover et al. ..... 439/607.07
4,975,084 A * 12/1990 Fedder et al. ..... 439/607.4
5,156,554 A * 10/1992 Rudoy et al. ..... 439/108
5,206,656 A * 4/1993 Hannan ..... 343/705
5,215,473 A * 6/1993 Brunker et al. ..... 439/108
5,321,373 A * 6/1994 Shusterman et al. ..... 333/12
5,645,436 A * 7/1997 Shimizu et al. ..... 439/108
6,203,376 B1 * 3/2001 Magajne et al. ..... 439/607.44
6,276,945 B1 * 8/2001 Hayward et al. ..... 439/82
6,394,822 B1 * 5/2002 McNamara ..... 439/108
6,461,202 B2 * 10/2002 Kline ..... 439/701
6,506,076 B2 * 1/2003 Cohen et al. ..... 439/607.09
6,517,360 B1 * 2/2003 Cohen ..... 439/65
6,540,522 B2 * 4/2003 Sipe ..... 439/61
6,551,140 B2 * 4/2003 Billman et al. ..... 439/607.07
6,602,095 B2 * 8/2003 Astbury et al. ..... 439/607.07
6,612,856 B1 * 9/2003 McCormack ..... 439/188
6,623,302 B2 * 9/2003 Billman et al. ..... 439/607.07
6,638,079 B1 * 10/2003 Billman et al. ..... 439/76.1
6,638,110 B1 * 10/2003 Billman ..... 439/607.07
6,645,009 B1 * 11/2003 Billman et al. ..... 439/607.07
6,663,401 B2 * 12/2003 Billman et al. ..... 439/76.1
6,663,427 B1 * 12/2003 Billman et al. ..... 439/607.07
6,682,369 B1 * 1/2004 Korsunsky et al. ..... 439/607.07
6,692,272 B2 * 2/2004 Lemke et al. ..... 439/108
6,692,305 B2 * 2/2004 Nelson et al. ..... 439/607.07
6,705,895 B2 * 3/2004 Hasircoglu ..... 439/607.07
6,712,646 B2 * 3/2004 Shindo ..... 439/607.07
6,808,419 B1 * 10/2004 Korsunsky et al. ..... 439/607.23
6,851,980 B2 * 2/2005 Nelson et al. ..... 439/607.05
6,872,085 B1 * 3/2005 Cohen et al. ..... 439/108
6,884,117 B2 * 4/2005 Korsunsky et al. ..... 439/607.11
6,988,902 B2 * 1/2006 Winings et al. ..... 439/79

(Continued)

FOREIGN PATENT DOCUMENTS

JP A-2010-73436 4/2010
JP A-2010-73641 4/2010

*Primary Examiner* — Amy Cohen Johnson
*Assistant Examiner* — Vladimir Imas
(74) *Attorney, Agent, or Firm* — Oliff PLC

(57) ABSTRACT

A ground contact plate in a contact unit includes fixing pieces provided at predetermined equal intervals in a longitudinal direction. The fixing pieces are respectively fitted in opposed slits in ground contact terminals via a transmission blade.

11 Claims, 15 Drawing Sheets

(56) References Cited

U.S. PATENT DOCUMENTS

| | | | | |
|---|---|---|---|---|
| 7,037,268 | B1 * | 5/2006 | Sleva et al. | 600/459 |
| 7,044,793 | B2 * | 5/2006 | Takemasa | 439/607.07 |
| 7,083,432 | B2 * | 8/2006 | Hull et al. | 439/79 |
| 7,108,522 | B2 * | 9/2006 | Verelst et al. | 439/108 |
| 7,108,556 | B2 * | 9/2006 | Cohen et al. | 439/607.08 |
| 7,121,889 | B1 * | 10/2006 | Jeon | 439/607.1 |
| 7,131,870 | B2 * | 11/2006 | Whiteman et al. | 439/607.06 |
| 7,316,585 | B2 * | 1/2008 | Smith et al. | 439/607.11 |
| 7,390,200 | B2 * | 6/2008 | Shuey et al. | 439/79 |
| 7,708,569 | B2 * | 5/2010 | Sercu et al. | 439/108 |
| 7,722,401 | B2 * | 5/2010 | Kirk et al. | 439/607.07 |
| 7,753,731 | B2 * | 7/2010 | Cohen et al. | 439/607.09 |
| 7,780,474 | B2 * | 8/2010 | Ito | 439/607.05 |
| 7,794,278 | B2 * | 9/2010 | Cohen et al. | 439/607.09 |
| 7,850,488 | B2 | 12/2010 | Ikegami et al. | |
| 8,277,261 | B2 * | 10/2012 | Matsuzawa | 439/701 |
| 8,460,032 | B2 * | 6/2013 | Kirk | 439/607.07 |
| 2004/0113854 | A1 * | 6/2004 | Lindenmeier | 343/713 |
| 2010/0068933 | A1 * | 3/2010 | Ikegami et al. | 439/607.05 |
| 2010/0075538 | A1 | 3/2010 | Ohshida | |

* cited by examiner

CONTACT UNIT AND PRINTED CIRCUIT BOARD CONNECTOR HAVING THE SAME

CROSS-REFERENCE TO RELATED APPLICATIONS

This application claims the benefit of Japanese Patent Application No. 2011-147319 filed Jul. 1, 2011, which is hereby incorporated by reference herein in its entirety.

BACKGROUND OF THE INVENTION

1. Field of the Invention

The present invention relates to a contact unit and a printed circuit board connector including multiple contact units.

2. Description of the Related Art

A communication system adopts a differential transmission system for data transmission in a high frequency range of 3 GHz or above, for example. A printed circuit board connector for electrically connecting printed circuit boards such as a motherboard and a daughterboard, for example, has been put into practical use in a transmission path which adopts the differential transmission system. As one of such printed circuit board connectors, a high-speed transmission connector is proposed as disclosed in Japanese Patent Application Laid-Open No. 2010-73436, for example. The proposed structure of the high-speed transmission connector is that a ground contact terminal is each placed between pairs of transmission contact terminals arranged on one of surfaces of a transmission blade that constitutes part of each blade type contact unit. Herewith, this structure prevents crosstalk between signal transmission paths within the common contact unit. Moreover, Japanese Patent Application Laid-Open No. 2010-73436 also proposes a structure in which multiple ground contact plates arranged on the other surface of the transmission blade each have a shield piece integrated with a joining portion. Hereby, this structure suppresses crosstalk between signal transmission paths of the adjacent contact units.

Further, as disclosed in Japanese Patent Application Laid-Open No. 2010-73641, for example, a structure of a ground plate in each transmission blade (which is referred to as a blade in Japanese Patent Application Laid-Open No. 2010-73641) is proposed in order to improve a high-speed transmission performance of a printed circuit board connector. Namely, there is proposed a structure in which one ground plate provided on one of surfaces of a transmission blade has multiple ground pieces arranged in a line at given intervals and corresponding to each of ground terminals arranged on the other surface of the transmission blade (see FIG. 3 in Japanese Patent Application Laid-Open No. 2010-73641). The ground pieces are formed integrally with the ground plate by press work such that tip ends of the ground pieces come into elastic contact with a flat surface of the ground terminal.

SUMMARY OF THE INVENTION

In the printed circuit board connectors described above, a distance between the contact terminals on the transmission blade tends to become shorter in order to meet demands for reduction in size of the connectors and ever-denser contact terminals. Along with such a tendency, the ground contact terminal may be elongated in the structure as shown in Japanese Patent Application Laid-Open No. 2010-73436 cited above in which the ground contact terminal is placed between a pair of transmission contact terminals and another pair of transmission contact terminals. In this case, the ground contact terminal may function as an antenna, whereby a noise component having a given wavelength corresponding to the length of the ground contact terminal may be radiated to signal lines of the adjacent transmission contact terminals. Herewith, a high-speed transmission performance may be deteriorated due to superposition of the noise component on signals in a predetermined high-frequency range in the signal lines.

On the other hand, as shown in Japanese Patent Application Laid-Open No. 2010-73641, in the structure in which the single ground plate in the transmission blade has multiple ground pieces arranged in a line at given intervals and corresponding to each ground terminal, the tip ends of the ground pieces are in elastic contact with the surface of the ground terminal. In other words, this structure is required to produce a given appropriate contact force, and accordingly has a limitation in reducing the length of the ground pieces. As a consequence, it may be more difficult to provide multiple ground pieces in a line at given intervals as the length of the ground pieces becomes shorter in order to meet the demand for reduction in size of the connector.

In view of the above-described problems, the present invention aims to provide a contact unit and a printed circuit board connector having multiple contact units. The contact unit and a printed circuit board connector having multiple contact units can improve a high-speed transmission performance independently of a length of a ground contact terminal in a transmission blade.

To achieve the object, a contact unit of an embodiment of the present invention includes a ground contact plate placed on a first surface portion of a transmission blade and having a plurality of fixation terminal portions to be fixed to a printed circuit board; a transmission contact terminal group placed on a second surface portion of the transmission blade opposite from the first surface portion and having a plurality of pairs of transmission contact terminals each of which has a fixation terminal portion to be fixed to the printed circuit board and forms a signal transmission path; and a plurality of ground contact terminals each placed between the pairs of the transmission contact terminals adjacent to each other and having a fixation terminal portion to be fixed to the printed circuit board. Each of the ground contact terminals has at least one slit to be fitted with at least one fixing piece formed in the ground contact plate via the transmission blade, thereby making a frequency of a noise component occurring at the ground contact terminal become out of a frequency range of a signal transmitted to the signal transmission path.

A printed circuit board connector of an embodiment of the present invention includes a contact unit including: a ground contact plate placed on a first surface portion of a transmission blade, and having a plurality of fixation terminal portions to be fixed to a printed circuit board; a transmission contact terminal group placed on a second surface portion of the transmission blade opposite with the first surface portion, and having a plurality of pairs of transmission contact terminals each of which has a fixation terminal portion to be fixed to the printed circuit board and forms a signal transmission path; and a plurality of ground contact terminals each placed between the pairs of the transmission contact terminals adjacent to each other and having a fixation terminal portion to be fixed to the printed circuit board; and a casing housing a plurality of the contact units. Each of the ground contact terminals in the contact unit has at least one slit to be fitted with at least one fixing piece formed in the ground contact plate via the transmission blade, thereby making a frequency of a noise component occurring at the ground contact terminal become out of a frequency range of a signal transmitted to the signal transmission path.

According to a contact unit and a printed circuit board connector having the same in accordance with the present invention, each of the ground contact terminals has at least one slit to be fitted with at least one fixing piece formed in the ground contact plate via the transmission blade. Thus a frequency of a noise component generated at the ground contact terminal is out of a frequency range of signals to be transmitted to a signal transmission path. Hence there is no risk of the noise component invading the frequency range used by such signals even when the ground contact terminal functions as an antenna. As a consequence, it is possible to improve a high-speed transmission performance independently of the length of the ground contact terminal in the transmission blade.

Further features of the present invention will become apparent from the following description of exemplary embodiments (with reference to the attached drawings).

DESCRIPTION OF THE EMBODIMENTS

Figure 2:
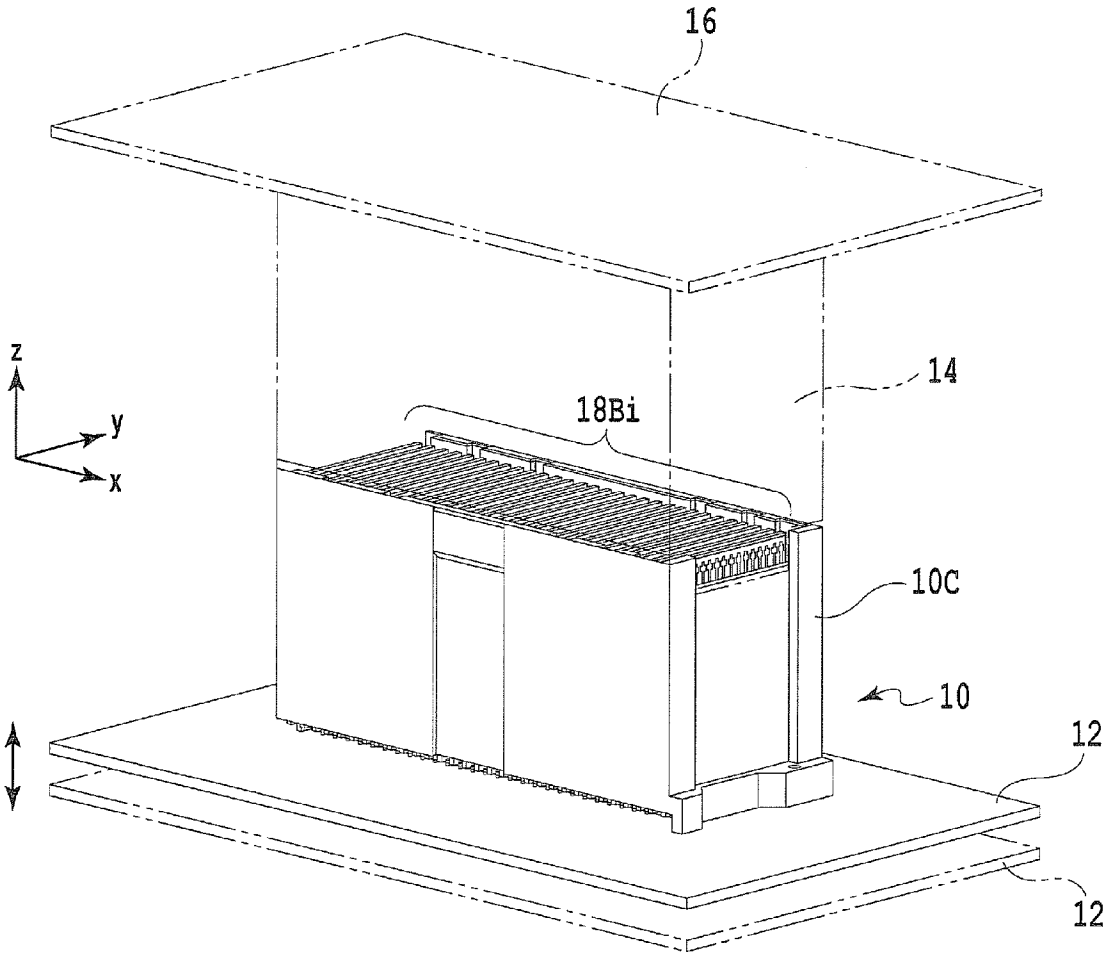
FIG. 2 is a perspective view schematically showing a configuration of an example of the printed circuit board connector according to the present invention together with printed circuit boards.

In FIG. 2, a printed circuit board connector as an example of a printed circuit board connector of an embodiment of the present invention is formed as a so-called board-to-board connector including a plug connector 10 to be fixed to a given printed circuit board 12 and a receptacle connector 14 to be fixed to another given printed circuit board 16. Each of the printed circuit boards (such as JIS code: JIS C 5603) 12 and 16 form printed circuits with integrated circuits and numerous electronic components, for example, being mounted on the boards.

The printed circuit board connector is designed to perform high-speed signal transmission between the printed circuit boards in a frequency range from 10 GHz to 14 GHz, for example. FIG. 2 shows a state in which the plug connector 10 is coupled to the receptacle connector 14.

Moreover, the printed circuit board connector can be selectively employed in a transmission mode of either a single end mode or a differential mode as described later.

Figure 12:
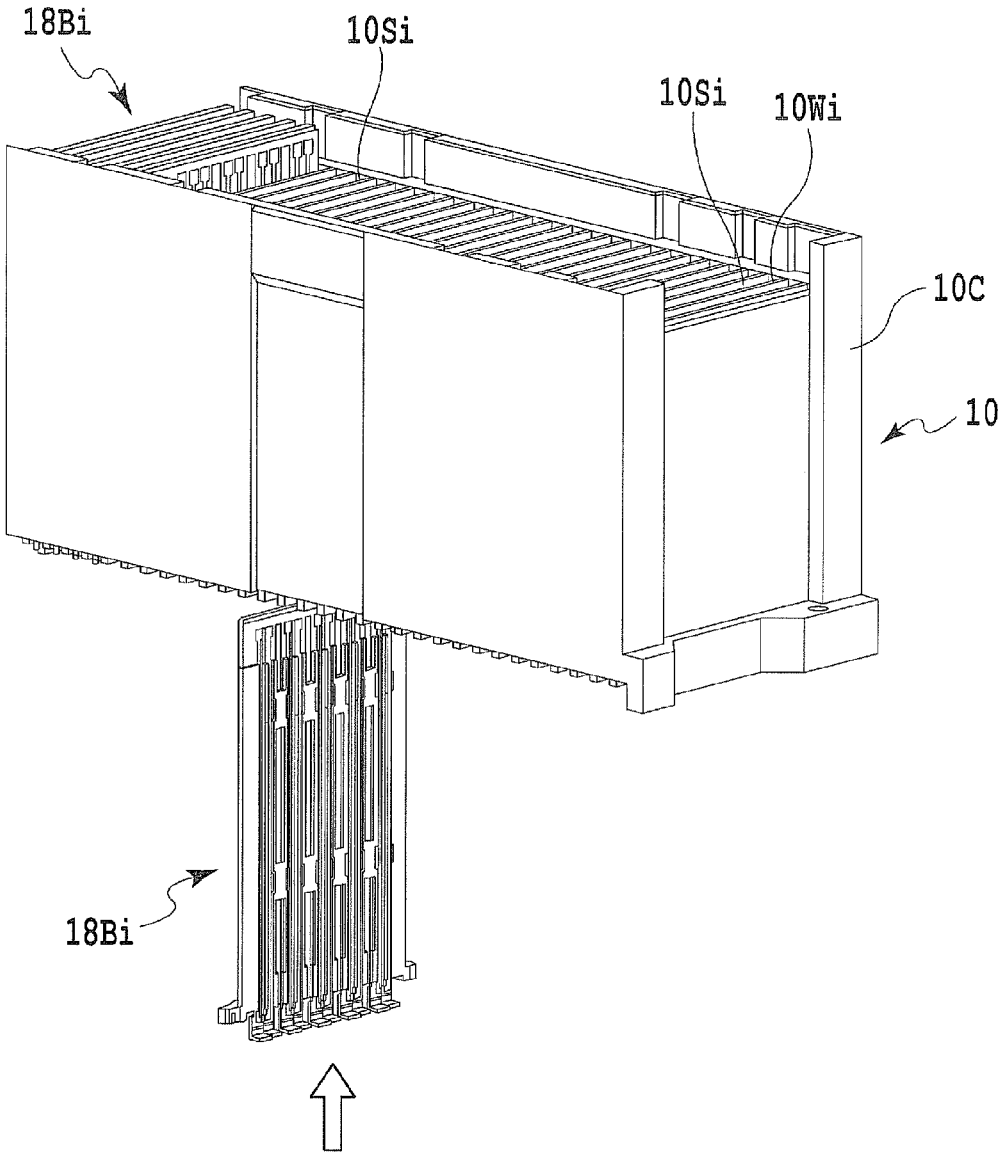
FIG. 12 is a perspective view made available for explanation of an operation to assemble the contact unit shown in FIG. 1 to a casing of the plug connector.

As indicated with chain double dashed lines in FIG. 2, the plug connector 10 has a structure which is attachable to and detachable from the receptacle connector 14. The plug connector 10 comprises a casing 10C provided with multiple slits 10Si (i=1 to n, n is a positive integer) (see FIG. 12). The multiple slits 10Si detachably house respective blade contact units 18Bi (i=1 to n, n is a positive integer) to be described later. The slits 10Si are arranged substantially parallel to one another at given intervals along an X coordinate axis in an orthogonal coordinate system shown in FIG. 2, i.e., a long side of the casing 10C. As shown in FIG. 12, the slits 10Si are partitioned by partition walls 10Wi therebetween.

The casing 10C is made of a resin material, or namely, any of liquid crystal polymer (LCP), polyetherimide (PEI), and polyethersulfone (PES), for example. The casing 10C has a bottom surface portion which is substantially parallel to a surface of the printed circuit board 12 on which a conductive pattern in formed. As shown in FIG. 12, openings that communicate with the aforementioned slits 10Si for housing the contact units 18Bi are provided at given intervals in the bottom surface portion of the casing 10C.

Fitting portions 26SH (see FIG. 1) of a transmission blade 26 of each blade contact unit 18Bi are each detachably fitted into an open end portion on the bottom surface portion of the casing 10C. Fixation terminal portions of each blade contact unit 18Bi are exposed on the bottom surface portion of the casing 10C.

Figure 1:
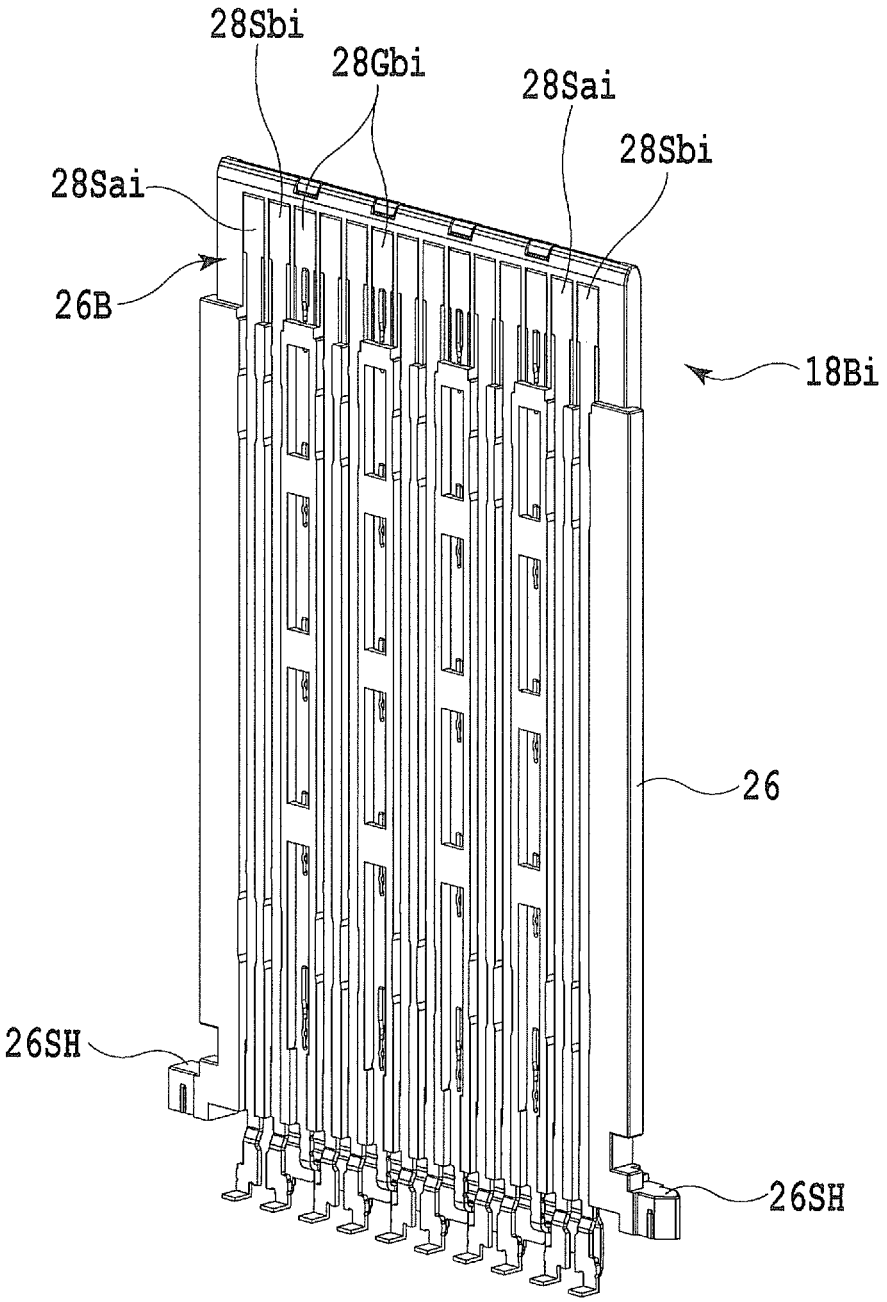
FIG. 1 is a perspective view showing an appearance of a blade type contact unit of a plug connector used for an example of a printed circuit board connector of an embodiment of the present invention.

As shown in the enlarged view of FIG. 1, each contact unit 18Bi used in the example of the printed circuit board connector according to the present invention includes one ground contact plate 28GA (see FIG. 5), four ground contact terminals 28Gbi (i=1 to 4) (see FIG. 1 and FIG. 3), multiple or five transmission contact terminals 28Sai and 28Sbi (i=1 to 5) each, for example, configured to transmit signals or data, and one transmission blade 26 which is configured to support the ground contact plate 28GA, the ground contact terminals 28Gbi, and the transmission contact terminals 28Sai and 28Sbi on surfaces.

The transmission blade 26 in a thin plate shape having a thickness of about 1 mm is made of a resin material, or namely, any of liquid crystal polymer (LOP), polyetherimide (PEI), and polyethersulfone (PES), for example. The transmission blade 26 has the fitting portions 26SH located on both ends at a lower end portion thereof and each configured to be fitted into the above-described open end portion of the slit 10Si. As shown in the enlarged view of FIG. 5, a groove 26DE in which the ground contact plate 28GA is press-fitted is partially formed on a lower part of a first surface portion 26A of the transmission blade 26. As shown in FIG. 1 and FIG. 6, dents 26R to be respectively engaged with multiple nibs of the ground contact plate 28GA are formed in predetermined positions on an upper part of a second surface portion 26B of the transmission blade 26 (see FIG. 6).

Meanwhile, as shown in the enlarged view of FIG. 6, relatively shallow grooves in which the ground contact terminals 28Gbi and the transmission contact terminals 28Sai and 28Sbi are respectively press-fitted are formed on the second surface portion 26B located on the opposite side of the first surface portion 26A of the transmission blade 26.

Figure 3:
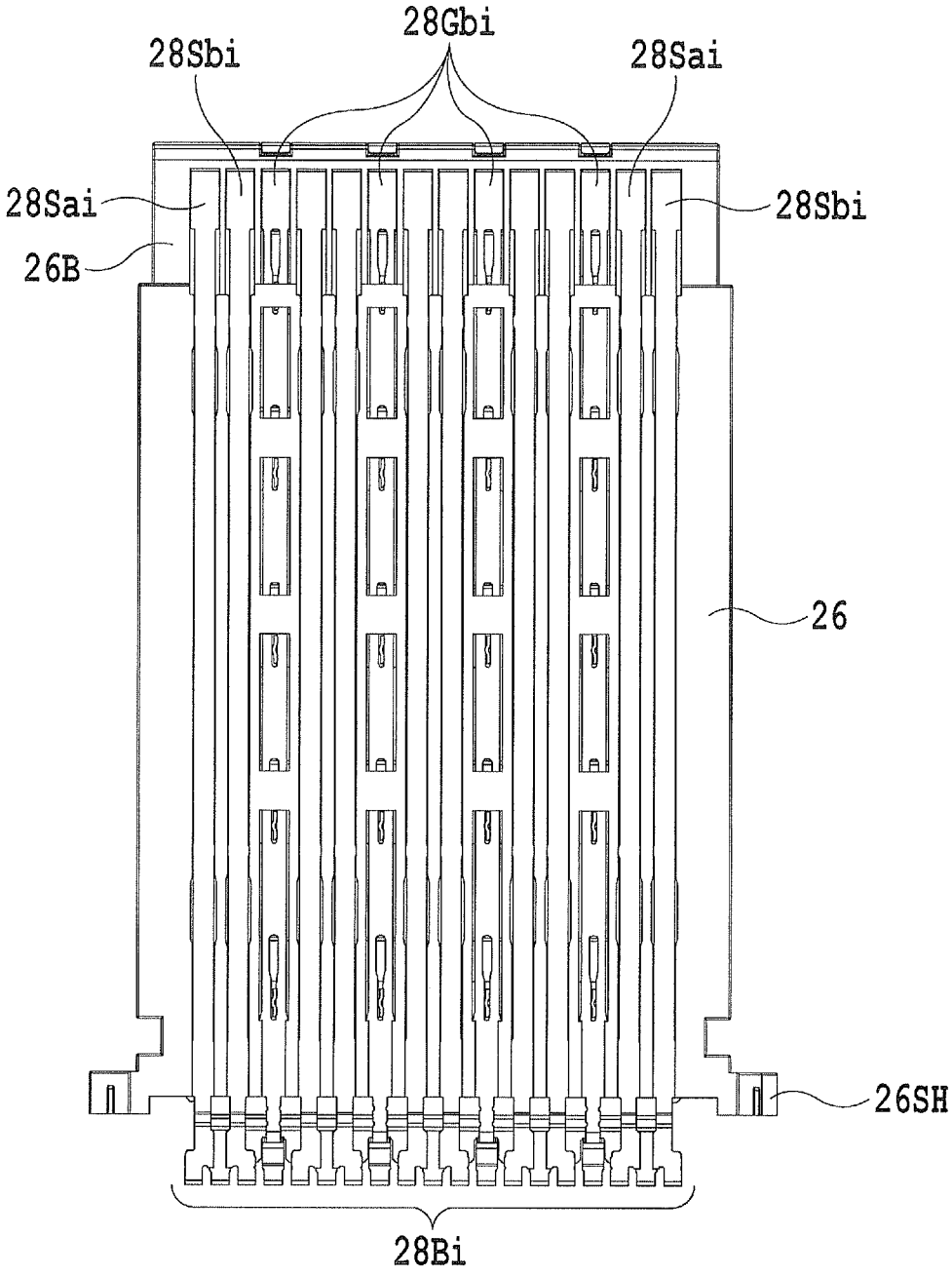
FIG. 3 is an elevational view of the contact unit in the example shown in FIG. 1, which is viewed from one surface side.

A pair of the transmission contact terminals 28Sai and 28Sbi, the first ground contact terminal 28Gbi, another pair of the transmission contact terminals 28Sai and 28Sbi, the second ground contact terminal 28Gbi, another pair of the transmission contact terminals 28Sai and 28Sbi, the third ground contact terminal 28Gbi, another pair of the transmission contact terminals 28Sai and 28Sbi, the fourth ground contact terminal 28Gbi, and another pair of the transmission contact terminals 28Sai and 28Sbi are arranged sequentially from the left end in FIG. 1 and FIG. 3 on the above-described second surface portion 26B of the transmission blade 26. Each of the aforementioned contact terminals is made into a thin plate shape of a copper alloy material such as beryllium copper or a phosphor bronze alloy.

Hereby, the ground contact terminals are located between the multiple pairs of the transmission terminals. Thus crosstalk between adjacent pairs of signal transmission paths is suppressed.

Figure 8A:
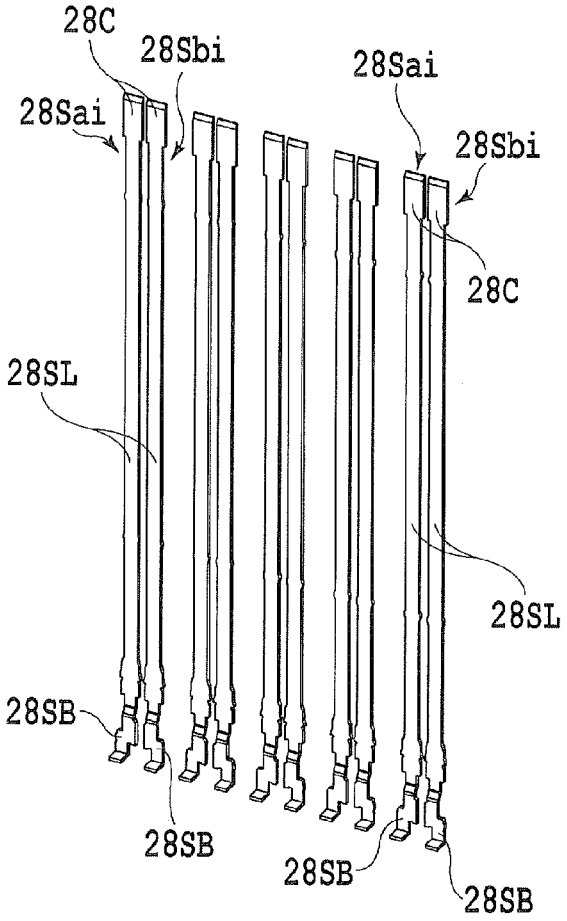
FIG. 8A is a perspective view showing multiple transmission contact terminals used in the example illustrated in FIG. 1

As shown in FIG. 8A, a pair of the transmission contact terminals 28Sai and 28Sbi each include a contact portion 28C formed at an upper end portion, a fixation terminal portion 28SB formed at a lower end portion, and a joining portion 28SL joining the contact portion 28C and the fixation terminal portion 28SB.

Figure 8B:
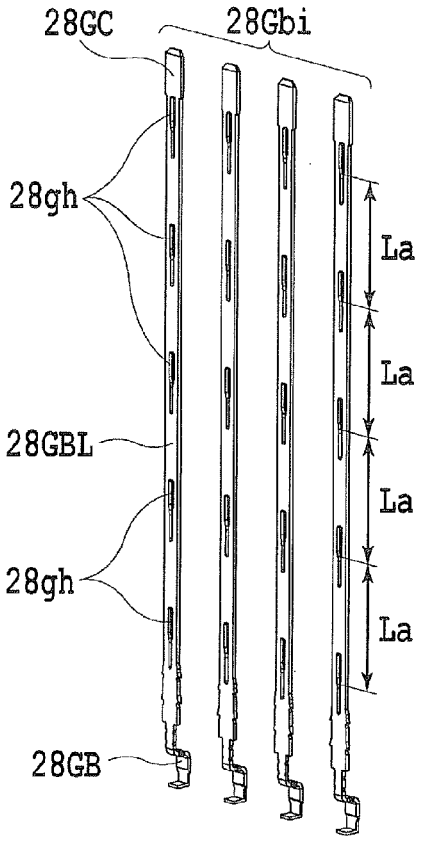
FIG. 8B is a perspective view showing multiple ground contact terminals used in the example illustrated in FIG. 1.

As shown in FIG. 8B, each of the ground contact terminals 28Gbi includes a contact portion 28GC formed at an upper end portion, a fixation terminal portion 28GB formed at a lowermost end portion, and a joining portion 28 GBL joining the contact portion 28GC and the fixation terminal portion 28GB.

When the plug connector 10 is coupled to the receptacle connector 14 to be described later, the contact portions 28C of the pair of the transmission contact terminals 28Sai and 28Sbi respectively come into contact with contact portions 48SC of transmission contact terminals 48Sai and 48Sbi of a contact unit 38Bi of the receptacle connector 14 (see FIG. 14). Meanwhile, the contact portion 28GC of the ground contact terminal 28Gbi comes into contact with a contact portion 48GC of a ground contact terminal 48Gbi of the contact unit 38Bi (see FIG. 14).

The fixation terminal portions 28SB of the pair of the transmission contact terminals 28Sai and 28Sbi as well as the fixation terminal portion 28SB of the ground contact terminal 28Gbi are each fixed by brazing such as soldering to be surface mounted on the printed circuit board 12. Herewith, the pair of the transmission contact terminals 28Sai and 28Sbi as well as the ground contact terminal 28Gbi are each electrically connected to circuit wiring on the printed circuit board 12. Alternatively, without limitation to the foregoing, the fixation terminal portions 28SB and 28GB, or fixation terminal portions 28*ga* to 28*ge* to be described later may be surface mounted on the printed circuit board 12 by means of solder terminals caulked to the fixation terminal portions as shown in Japanese Patent Application Laid-Open No. 2010-73436, for instance.

Meanwhile, when through-holes are formed on the circuit wiring on the printed circuit board 12, the fixation terminal portions 28SB and the fixation terminal portions 28GB may be through-hole mounted by forming the fixation terminal portions into a lead shape or a press-fit shape.

Figure 7:
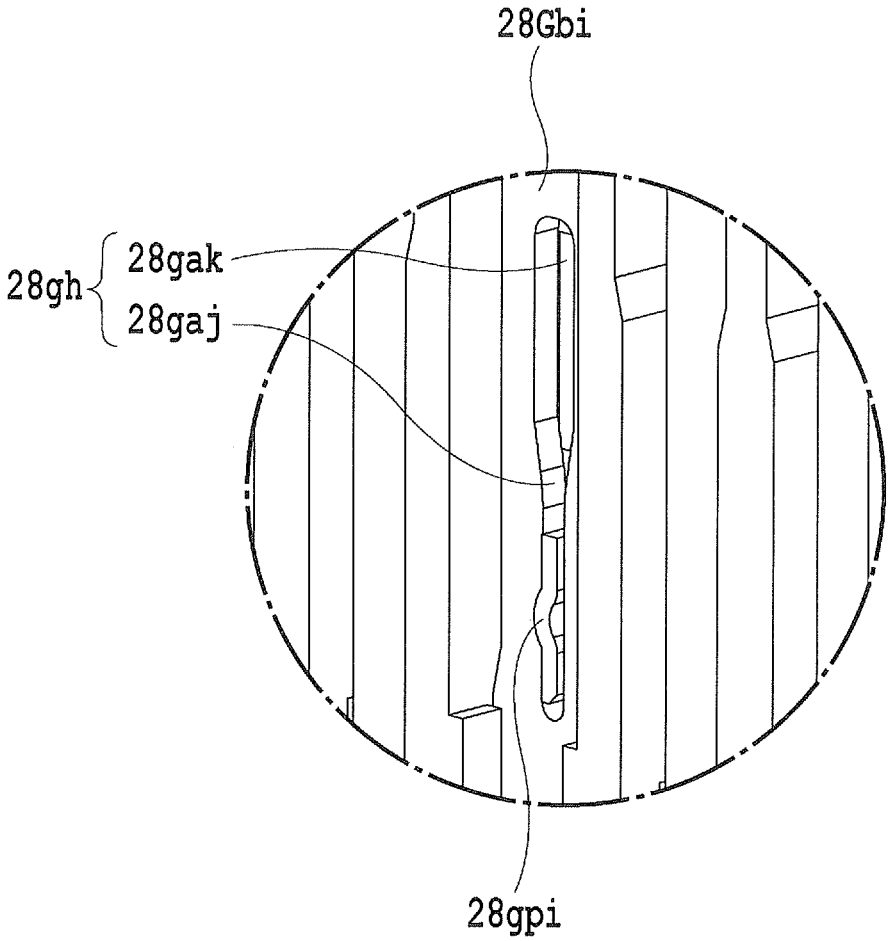
FIG. 7 is a partial enlarged perspective view showing a part in FIG. 1.

The joining portion 28GBL of the ground contact terminal 28Gbi includes five slits 28*gh* which are arranged in a line at equal intervals of a predetermined distance La. Each fixing piece 28*gpi* on the ground contact plate 28GA to be described later is fitted in each slit 28*gh*. As shown in the enlarged view of FIG. 7, each of the slits 28*gh* includes an enlarged portion 28*gak* and a reduced portion 28*gaj* continuous to the enlarged portion 28*gak*. The distance La is equivalent to a value of an interval between center positions of adjacent slits 28*gh*.

The distance La (=a wavelength λ (m) of an electromagnetic wave) between the slits 28*gh* is defined in accordance with the following formula (1) expressed by a frequency (f (MHz)) and a wavelength shortening rate ($K=1/\sqrt{\epsilon}$) (%). Note that ϵ is relative permittivity. The value K is set in a range from 50% to 80%, for example.

$$La=300\div f\times K \quad (1)$$

In the case where a frequency of a transmission signal is equal to 10 GHz, the distance La is equal to about 0.03K (m) when a frequency of a noise component that is likely to occur at the ground contact terminal 28Gbi is set to 15 GHz which is above 14 GHz. Thus, the distance La is set to a value smaller than about 0.03K. Accordingly, the number of the slits 28*gh* is set based on the length of the joining portion 28GBL and on the distance La.

As described above, by setting the intervals between the slits 28*gh* that fit the fixing pieces 28*gpi* to be described later and the fixing pieces 28*gpi* to the intervals narrower than the distance La calculated by the above-described formula (1) depending on the frequency of the transmission signal, the frequency of the noise component that is likely to occur at the ground contact terminal 28Gbi becomes higher than the frequency of the transmission signal. As a result, the noise component is prevented from superposing on the transmission signal. Moreover, dimensional management of the distances is simplified with the distance La of the intervals being the same. Thus it is possible to form the fixing pieces 28*gpi* easily. Moreover, with the distance La of the intervals being the same, it is possible to concentrate the frequency of the noise component occurring at the ground contact terminal 28Gbi approximately on a predetermined frequency. As a consequence, superposition of the noise component on the transmission signal can be avoided more stably.

Moreover, the distances La among the slits 28*gh* do not have to be the same when the frequency of the noise component that is likely to occur at the ground contact terminal 28Gbi is set higher than the frequency of the transmission signal.

Accordingly, it is possible to set the distances between the slits so as to avoid the noise component that is likely to occur at the ground contact terminal 28Gbi from superposing on the signal transmitted signal line independently of the length of the ground contact terminal.

Figure 4:
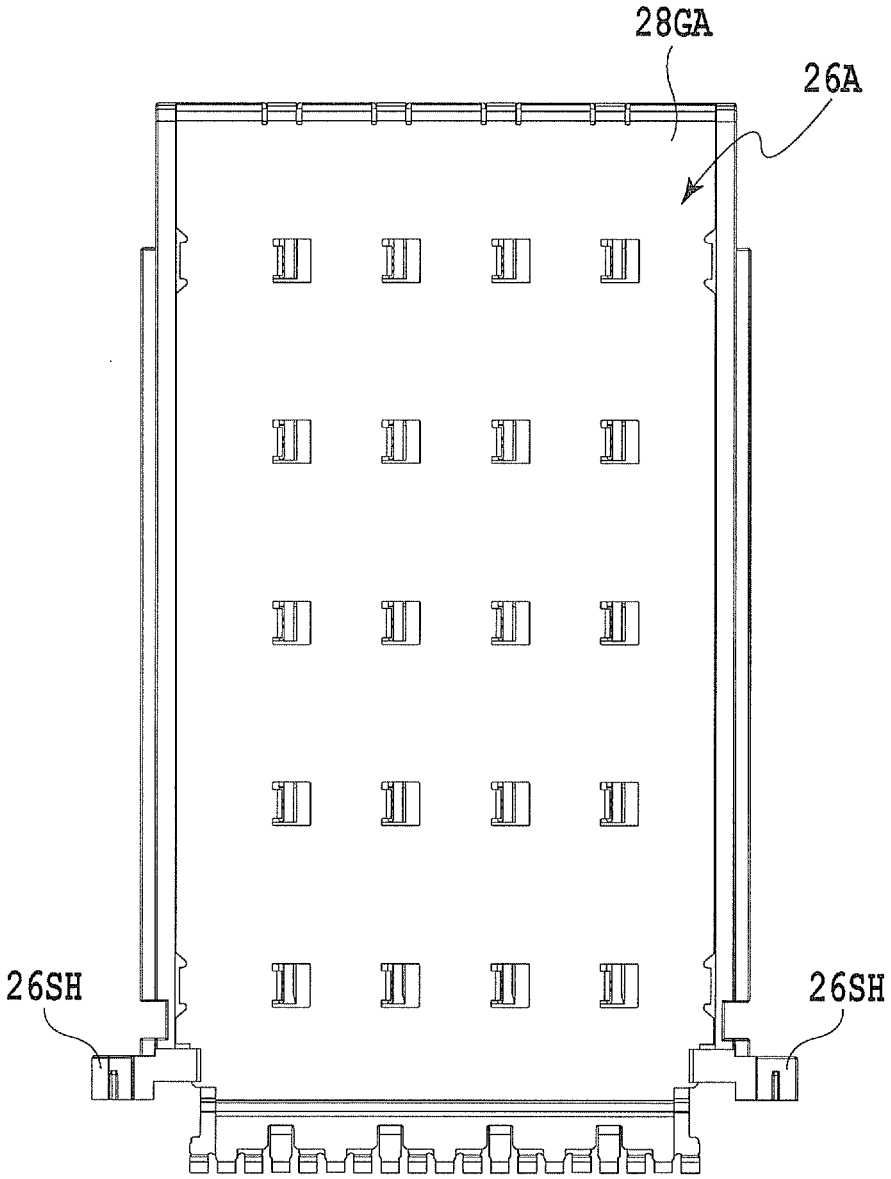
FIG. 4 is an elevational view of the contact unit in the example shown in FIG. 1, which is viewed from another surface side.
Figure 9:
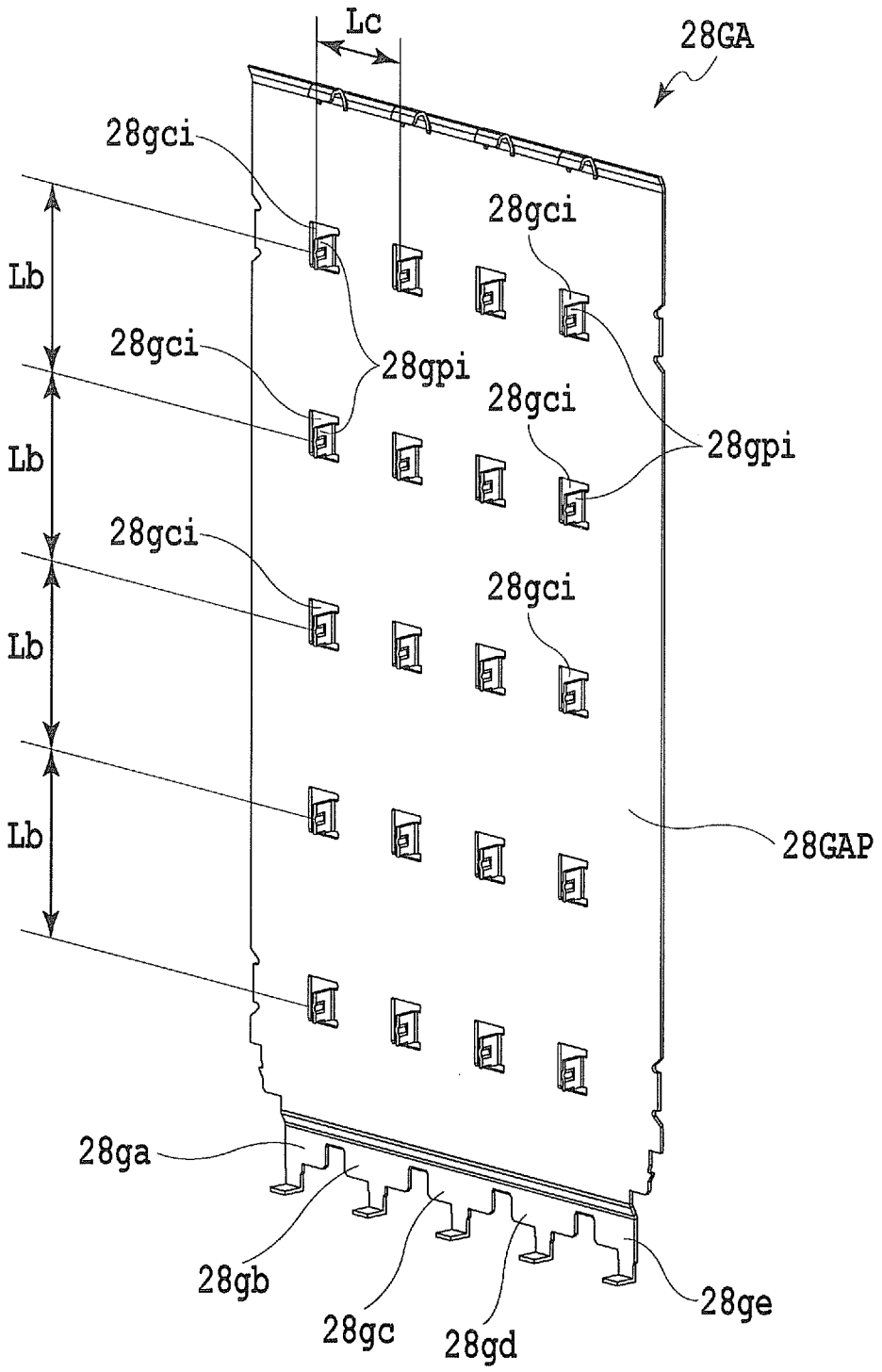
FIG. 9 is a perspective view showing a ground contact plate used in the example illustrated in FIG. 1.

As shown in FIG. 4, the ground contact plate 28GA is fixed to the first surface portion 26A of the transmission blade 26. The ground contact plate 28GA is formed into a thin plate shape by using a copper alloy material such as beryllium copper or a phosphor bronze alloy. As shown in FIG. 9, the ground contact plate 28GA includes a contact portion formed on one end, the fixation terminal portions 28*ga*, 28*gb*, 28*gc*, 28*gd*, and 28*ge* formed on another end and provided with bent portions, and a flat surface portion 28GAP which joins the adjacent fixation terminal portions 28*ga*, 28*gb*, 28*gc*, 28*gd*, and 28*ge* to one another and joins the contact portion and the fixation terminal portions 28*ga*, 28*gb*, 28*gc*, 28*gd*, and 28*ge*.

A tip end of the contact portion is bent into an arc shape in conformity to a tip end portion of the transmission blade 26. The multiple nibs are provided separately from one another on the tip end of the contact portion. The nibs are each formed by being bent into an arc shape in such a manner as to be engaged with the dents 26R that are formed on the second surface portion 26B of the transmission blade 26 so as to correspond to the respective nibs. As shown in the enlarged view of FIG. 6, since the nibs are engaged with the dents 26R of the transmission blade 26, the nibs can be used as positioning means for the ground contact plate 28GA with respect to the transmission blade 26 when the ground contact plate 28GA is fixed by press-fitting to the transmission blade 26. Moreover, since the nibs are engaged with the dents 26R of the transmission blade 26, the ground contact plate 28GA is prevented from being separated from the first surface portion 26A of the transmission blade 26.

The fixation terminal portions 28*ga*, 28*gb*, 28*gc*, 28*gd*, and 28*ge* are formed in a line at given intervals along a short side of the transmission blade 26. As shown in FIG. 9, the bent portions of the fixation terminal portions 28*ga* to 28*ge* are fixed by brazing such as soldering to be surface mounted on the printed circuit board 12, thereby being electrically connected to the circuit wiring on the printed circuit board 12. Meanwhile, when through-holes are formed on the circuit wiring on the printed circuit board 12, the fixation terminal portions may be through-hole mounted by forming the fixation terminal portions into a lead shape or a press-fit shape.

The flat surface portion 28GAP has the multiple fixing pieces 28*gpi* (i=1 to 20) formed in a matrix at given intervals. The fixing pieces 28*gpi* are formed in four lines corresponding to the number of the ground contact terminals 28Gbi mentioned above. Separation distances Lc among the adjacent rows are set in accordance with an interval between center axis lines of the adjacent ground contact terminals 28Gbi. In the meantime, separation distances Lb among the fixing pieces 28*gpi* in each row are set in accordance with the distances La among the center portions of the slits 28*gh* in the ground contact terminals 28Gbi.

The fixing pieces 28*gpi* are each bent toward the first surface portion 26A of the transmission blade 26 by press work in such a manner as to be perpendicular to the second surface portion 26B. Openings 28*gci* (i=1 to 20) are formed around the respective fixing pieces 28*gpi*. Tip ends of the respective fixing pieces 28*gpi* are fitted in the reduced portions 28*gaj* of the slits 28*gh* in the respective ground contact terminals 28Gbi through slits 26*di* (i=1 to 20) (see FIG. 11B) formed in the transmission blade 26 so as to correspond to the respective fixing pieces 28*gpi*.

Figure 10A:
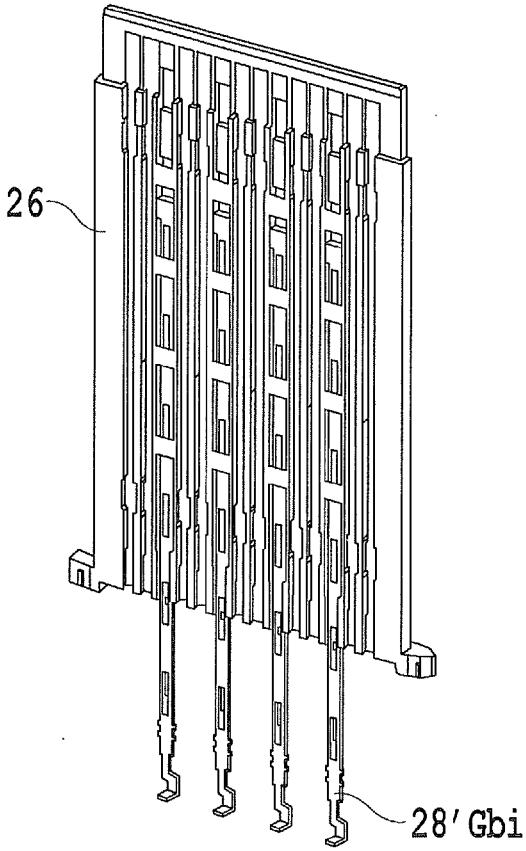
FIG. 10A and FIG. 10B are perspective views each made available for explanation of operations to assemble the transmission contact terminals and the ground contact terminals to a transmission blade.
Figure 10B:
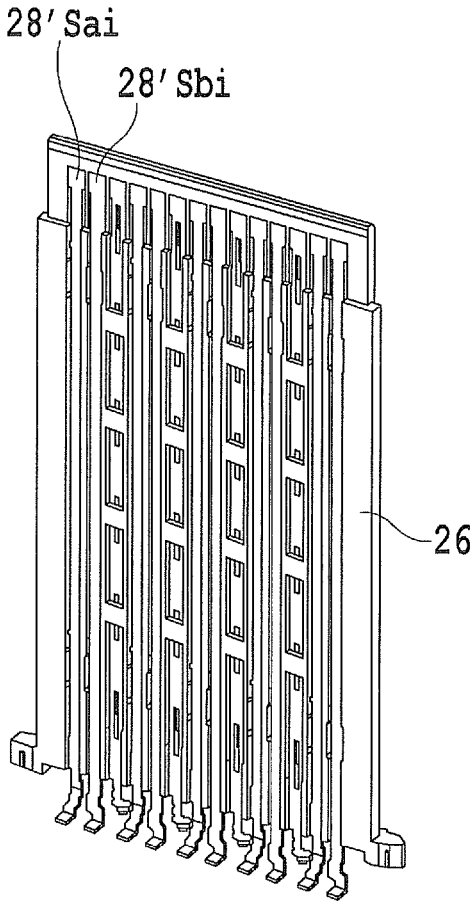
Figure 11A:
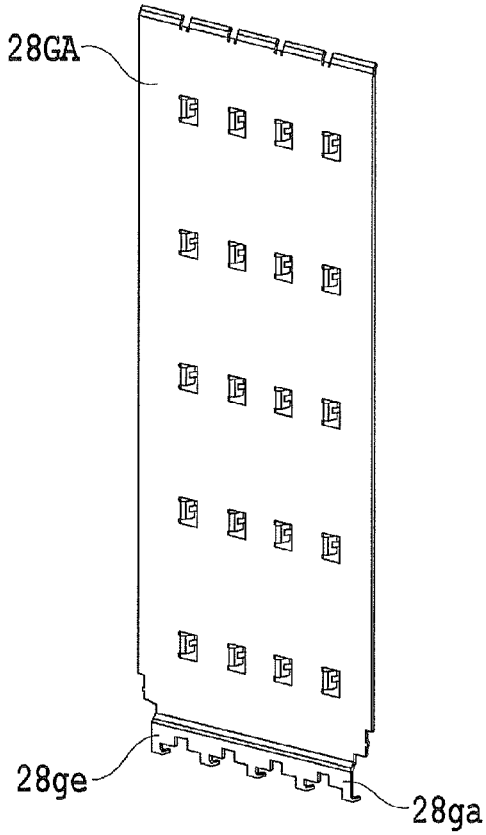
FIG. 11A and FIG. 11B are perspective views each made available for explanation of an operation to assemble the ground contact plate to the transmission blade.
Figure 11B:
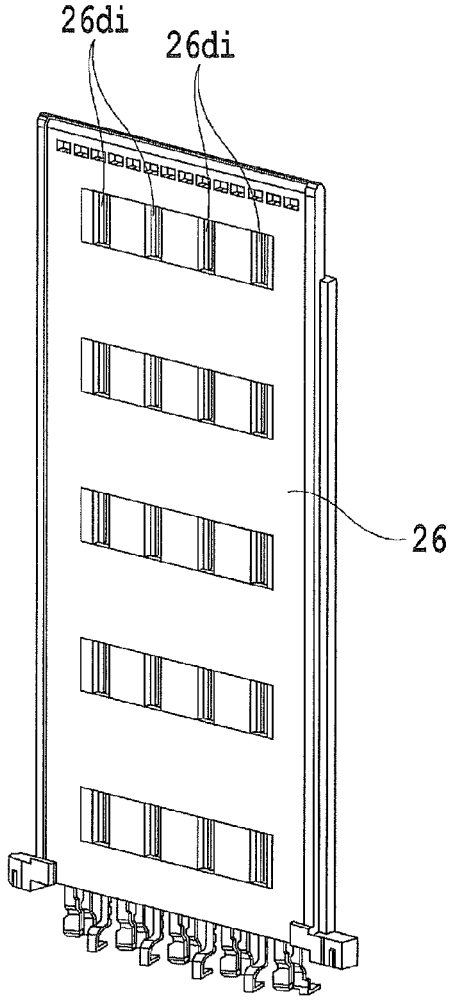

Each of the contact units 18Bi described above is assembled by using the transmission contact terminals 28Sai and 28Sbi, the ground contact terminals 28Gbi, and the ground contact plate 28Ga and in accordance with the following procedures. First, as shown in FIGS. 10A and 10B, the transmission contact terminals 28Sai and 28Sbi and the ground contact terminals 28Gbi are respectively press-fitted in the grooves formed on the second surface portion 26B of the transmission blade 26. Next, as shown in FIG. 11, the ground contact plate 28GA is placed on the first surface portion 26A of the transmission blade 26. Moreover, the tip ends of the respective fixing pieces 28*gpi* of the ground contact plate 28GA project through the slits 26*di* formed in the transmission blade 26 and are located at the enlarged portions 28*gak* of the slits 28*gh* in the respective ground contact terminals 28Gbi.

Then, the ground contact plate 28GA is fixed to the first surface portion 26A by sliding the ground contact plate 28GA on the transmission blade 26 toward the fixation terminals. Therefore, the assembly of the contact unit 18Bi is completed. Thereafter, the respective contact units 18Bi thus finished are inserted to the respective slits 10Si through the openings in the casing 10C as shown in FIG. 12.

Moreover, the tip end of each of the fixing pieces 28*gpi* on the ground contact plate 28GA is moved from the enlarged portion 28*gak* to the reduced portion 28*gaj* of the slit 28*gh* in each of the ground contact terminals 28Gbi due to the slide of the ground contact plate 28GA. Hereby, the tip end of the fixing piece 28*gpi* is fitted in the reduced portion 28*gaj*. The fitted portion of the fixing piece 28*gpi* slidably touches on the reduced portion 28*gaj* and gets wiped. Accordingly, if an oxide layer or a foreign object adheres to the fitted portion of the fixing piece 28*gpi*, such an obstacle will be removed properly. Thus the fixing piece 28*gpi* and the ground contact terminal 28Gbi are reliably and stably conducted to each other. Moreover, the fixation terminal portions 28*ga*, 28*gb*, 28*gc*, 28*gd*, and 28*ge* are located in such a manner as to cover the fixation terminal portions 28SB of the transmission contact terminals 28Sai and 28Sbi. Since the fixation terminal portions 28*ga* to 28*ge* of the ground contact plate 28GA cover the fixation terminal portions 28SB of the transmission contact terminals 28Sai and 28Sbi, crosstalk among the contact units 18Bi inserted to the respective slits 10Si of the casing 10C can be reduced.

Figure 5:
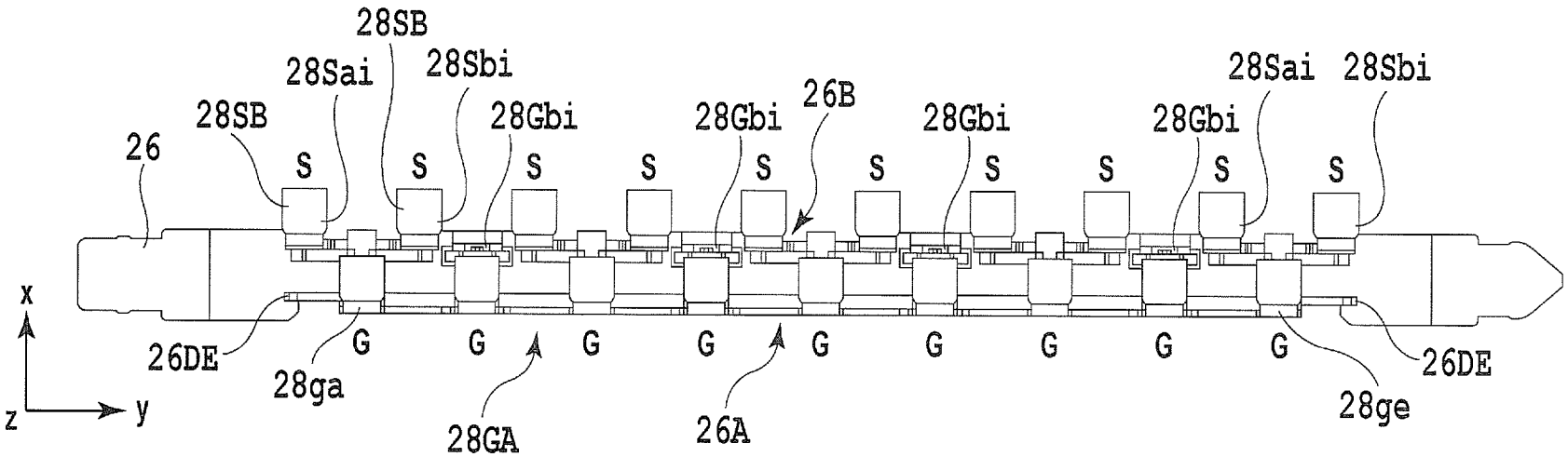
FIG. 5 is an enlarged bottom view of the example shown in FIG. 1.
Figure 6:
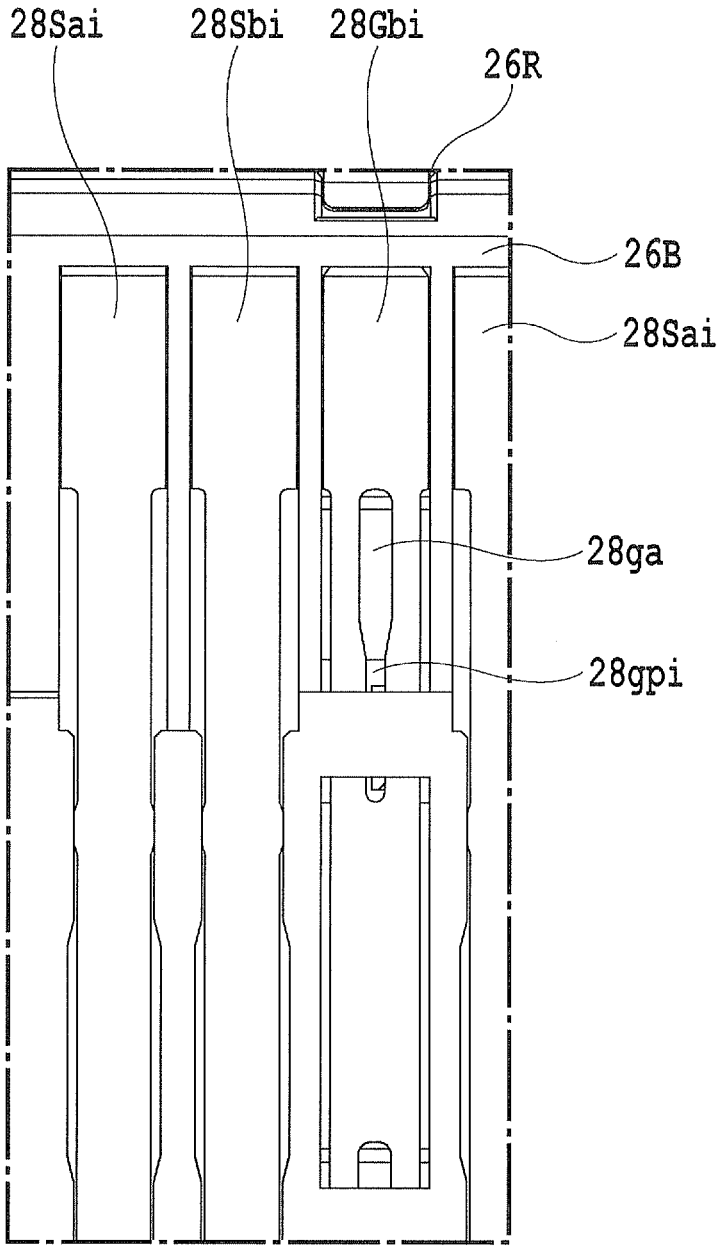
FIG. 6 is a partial enlarged elevational view showing a part in FIG. 3.

The fixation terminal portions 28SB of the transmission contact terminals 28Sai and 28Sbi on the second surface portion 26B of the transmission blade 26 are arranged at given intervals in a single row extending along the Y coordinate axis shown in FIG. 5. In the meantime, the fixation terminals portions 28*ga* to 28*ge* of the ground contact plate 28GA on the first surface portion 26A of the transmission blade 26 as well as the fixation terminals portions 28GB of the ground contact terminals 28Gbi are arranged at given intervals in a single row extending along the Y coordinate axis shown in FIG. 5.

Moreover, the row of the fixation terminal portions 28SB of the transmission contact terminals 28Sai and 28Sbi is formed substantially parallel to the row of the fixation terminal portions 28*ga* to 28*ge* of the ground contact plate 28GA. Meanwhile, the fixation terminal portions 28*ga* to 28*ge* of the ground contact plates 28GA are each located in a position corresponding to a space between the fixation terminal portions 28SB of a set of the transmission contact terminals 28Sai and 28Sbi. Further, the fixation terminal portion 28GB of the ground contact terminal 28Gpi to be located between an adjacent set of the transmission contact terminals 28Sai and 28Sbi and still another set of the transmission contact terminals 28Sai and 28Sbi is evenly spaced in the row of the fixation terminal portions 28*ga* to 28*ge* of the ground contact plate 28GA. That is, the fixation terminal portions 28GB of the ground contact terminals 28Gbi are located in the respective spaces between the fixation terminal portions 28*ga* to 28*ge* of the ground contact plate 28GA.

Although the four ground contact terminals 28Gbi are representatively arranged in FIG. 1, the number of the ground contact terminals 28Gbi may appropriately be set in accordance with the conductive pattern on the printed circuit board 12 without limitation to the above example. The conductive pattern on the printed circuit board 12 may be selected as appropriate depending on whether the system employs the transmission mode of the single end mode or the differential mode.

On the other hand, the receptacle connector 14 has slits in an inner side on one end portion of a casing (not shown), which are configured to penetrate the casing in accordance with the contact units 38Bi to be described later. The casing is made of a resin material, or namely, any of liquid crystal polymer (LCP), polyetherimide (PEI), and polyethersulfone (PES), for example. Inside dimensions of each of the slits are set slightly larger than the thickness of the contact unit 38Bi. The adjacent slits described above are partitioned by partition walls.

Figure 13:
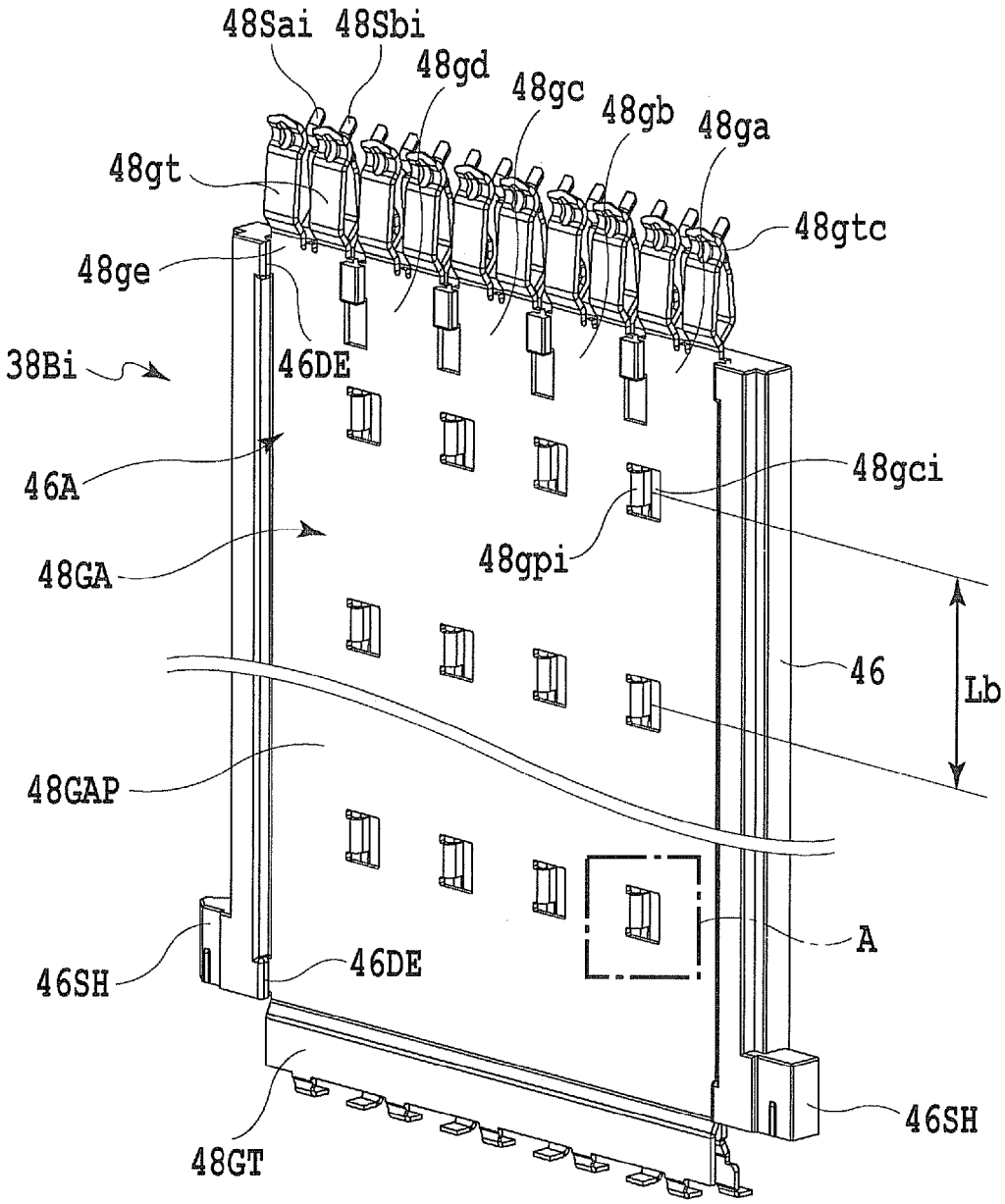
FIG. 13 is a perspective view showing an appearance of a blade type contact unit of a receptacle connector used for an example of the printed circuit board connector of an embodiment of the present invention.

Moreover, the contract units 38Bi shown in FIG. 13 are respectively housed in the multiple slits of the casing.

One of open ends on each of the slits of the casing is open in an end surface of the receptacle connector 14 to be fixed to the printed circuit board 16. Multiple fixation terminal portions to be described later are each exposed on the one open end of each of the slits.

The receptacle contact unit 38Bi is electrically connected to the transmission contact terminals 28Sai and 29Sbi, the ground contact terminals 28Gbi, and the ground contact plate 28GA of each of the contact units 18Bi of the plug connector 10 described above.

Figure 14:
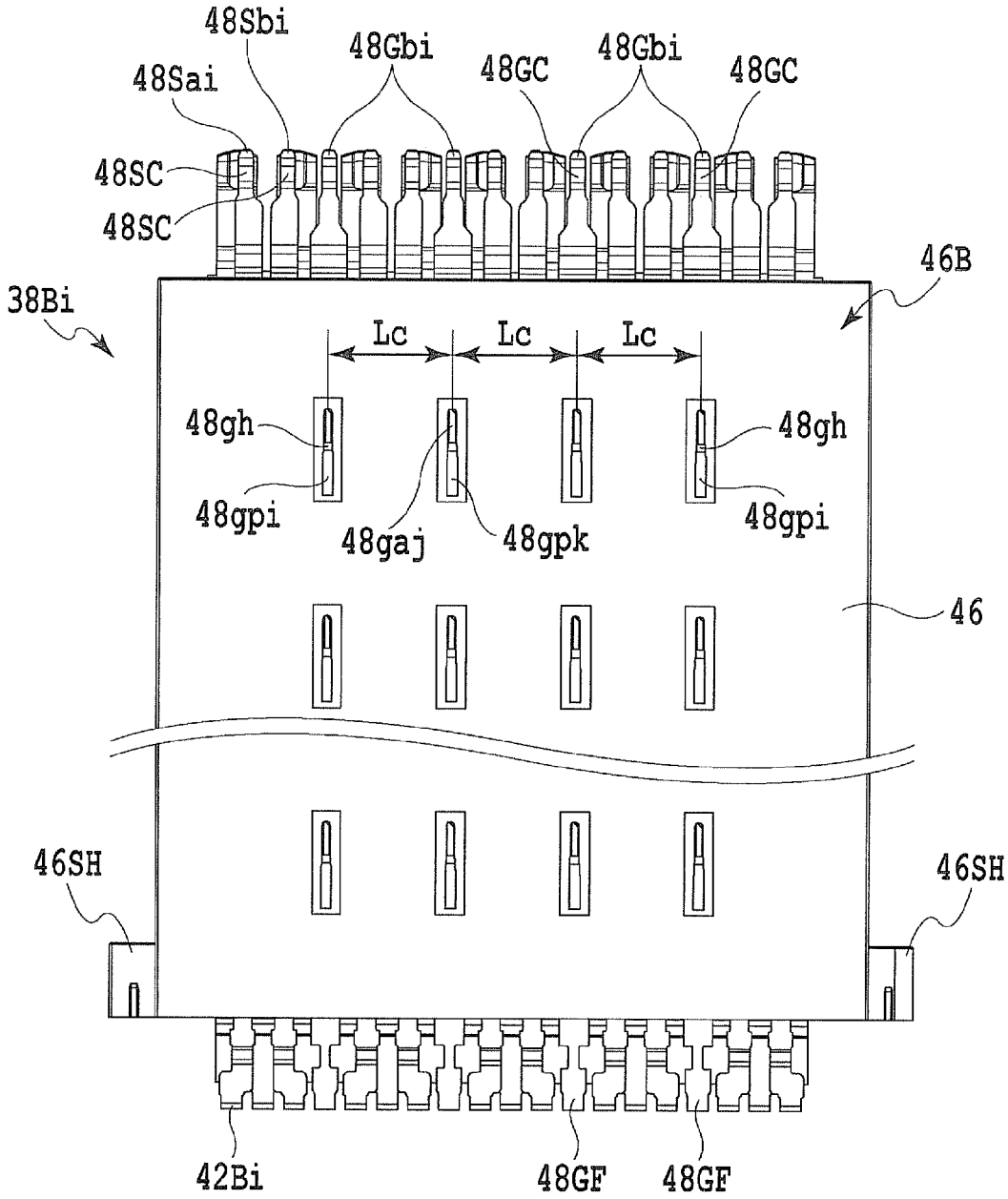
FIG. 14 is an elevational view of the contact unit shown in FIG. 13.

As shown in the enlarged view of FIG. 13 and FIG. 14, the receptacle contact unit 38Bi comprises one ground contact plate 48GA, four ground contact terminals 48Gbi (i=1 to 4), five pairs, for example, of transmission contact terminals 48Sai and 48Sbi (i=1 to 5) configured to transmit signals or data, and one transmission blade 46. The one transmission blade 46 supports each of the ground contact plate 48GA, the ground contact terminals 48Gbi, and the transmission contact terminals 48Sai and 48Sbi on a first surface portion 46A and a second surface portion 46B.

Note that FIG. 13 and FIG. 14 representatively illustrate one receptacle contact unit 38Bi.

The transmission contact terminals 48Sai and 48Sbi, the ground contact plate 48GA, and the ground contact terminals 48Gbi in the receptacle contact unit 38Bi are respectively arranged corresponding to the layouts of the transmission contact terminals 28Sai and 28Sbi, the ground contact plate 28GA, and the ground contact terminals 28Gbi in the contact unit 18Bi of the plug connector 10.

Namely, the contact unit 18Bi of the plug connector 10 is sandwiched between contact portions of the transmission contact terminals 48*sai* and 48Sbi as well as the ground contact terminals 48Gbi to be described later and connection terminals 48*gt* arranged in multiple pairs in a line on an upper part of the ground contact plate 48GA at a given pressure based on an elastic force therefrom.

Herewith, the transmission contact terminals 48Sai and 48Sbi are coupled to the transmission contact terminals 28Sai and 28Sbi of the contact unit 18Bi of the plug connector 10. Meanwhile, the ground contact plate 48GA and the ground contact terminals 48Gbi are respectively coupled to the ground contact plate 28GA and the ground contact terminals 28Gbi of the contact unit 18Bi.

The transmission blade 46 in a thin plate shape having a thickness of about 1 mm is molded of a resin material, or namely, any of liquid crystal polymer (LCP), polyetherimide (PEI), and polyethersulfone (PES), for example. The transmission blade 46 has fitting portions 46SH located on both ends at a lower end portion thereof and configured to be fitted into the above-described open end portion of the slit of the casing. A groove 46DE (see FIG. 13) in which each ground contact plate 48GA is press-fitted is formed on a lower part of the first surface portion 46A of the transmission blade 46. Positioning members to be press-fitted in respective press-fit grooves on the ground contact plate 48GA to be described later are formed in predetermined positions on an upper part of the first surface portion 46A. Each of the press-fit grooves is formed between adjacent pairs of the connection terminals 48*gt* on the upper part of the ground contact plate 48GA. Thus, the ground contact plate 48GA is fixed to the first surface portion 46A by using two portions of the upper part and the lower part of the first surface portion 46A. Accordingly, the ground contact plate 48GA is prevented from being separated from the first surface portion 46A of the transmission blade 46 by means of the two portions.

Meanwhile, as shown in FIG. 14, contact portions to be formed at upper parts of the ground contact terminals 48Gbi as well as the transmission contact terminals 48Sai and 48Sbi, which are casted simultaneously at the time of insert molding, project on an end portion of the second surface portion 46B of the transmission blade 46. A pair of the transmission contact terminals 48Sai and 48Sbi, the first ground contact terminal 48Gbi, another pair of the transmission contact terminals 48Sai and 48Sbi, the second ground contact terminal 48Gbi, another pair of the transmission contact terminals 48Sai and 48Sbi, the third ground contact terminal 48Gbi, another pair of the transmission contact terminals 48Sai and 48Sbi, the fourth ground contact terminal 48Gbi, and another pair of the transmission contact terminals 48Sai and 48Sbi are arranged sequentially from the left end in FIG. 14. Each of the aforementioned contact terminals is formed into a thin plate shape by use of a copper alloy material such as beryllium copper or a phosphor bronze alloy.

Each pair of the transmission contact terminals 48Sai and 48Sbi comprise contact portions 48SC formed at upper portions, fixation terminal portions 42Bi formed at lower end portions, and joining portions (not shown) joining the contact portions 48SC and the fixation terminal portions 42Bi.

The joining portion has substantially the same shape as the above-described joining portion 28SL (see FIG. 8A). Meanwhile, as shown in FIG. 14, each ground contact terminal 48Gbi comprises a contact portion 48GC formed at an upper portion and having elasticity, a fixation terminal portion 48GF formed at a lower end portion, and a joining portion (not shown) joining the contact portion 48GC and the fixation terminal portion 48GF. The joining portion has substantially the same shape as the above-described joining portion 28 GBL (see FIG. 83). The fixation terminal portions 42Bi and the fixation terminal portions 48GF are each fixed by brazing such as soldering to be surface mounted on the printed circuit board 16, thereby being electrically connected to circuit wiring on the printed circuit board 16. Meanwhile, when through-holes are formed on the circuit wiring on the printed circuit board 16, the fixation terminal portions may be through-hole mounted by forming the fixation terminal portions into a lead shape or a press-fit shape.

As shown in FIG. 13, the ground contact plate 48GA is fixed to the first surface portion 46A of the transmission blade 46. The ground contact plate 48GA is formed into a thin plate shape by use of a copper alloy material such as beryllium copper or a phosphor bronze alloy.

The ground contact plate 48GA comprises multiple pairs of the connection terminals 48*gt* projecting upward from the upper end portion of the transmission blade 46 and having elasticity, a projection piece 48GT projecting perpendicularly to the surface of the printed circuit board 16, and a flat surface portion 48GAP joining the projection piece 48GT and the multiple connection terminals 48*gt*.

A tip end portion of each of the connection terminals 48*gt* has a contact portion 48*gtc* which is bent into an arc shape. When the aforementioned plug connector 10 is coupled to the receptacle connector 14, the contact portions 48*gtc* of the multiple pairs of the connection terminals 48*gt* come into contact with the contact portions of the ground contact plate 28GA of the contact unit 18Bi. The projection piece 48GT is connected to the flat surface portion 48GAP in such a manner as to cover an array of all the fixation terminal portions 42Bi of the transmission contact terminals 48Sai and 48Sbi. Since the projection piece 48GT is thus arranged to cover the fixation terminal portions 42Bi of the transmission contact terminals 48Sai and 489Sbi as described above, crosstalk between the contact units 38Bi inserted to the respective slits of the casing can be reduced.

The above-mentioned flat surface portion 48GAP has multiple fixing pieces 48*gpi* (i=1 to 20) formed in a matrix at given intervals. The fixing pieces 48*gpi* are formed in four lines corresponding to the four ground contact terminals 48Gbi mentioned above. Separation distances Lc among the adjacent rows are set in accordance with intervals among center axis lines of the adjacent ground contact terminals 48Gbi. In the meantime, separation distances Lb among the fixing pieces 48*gpi* in the respective rows are evenly set in accordance with distances among center portions of the slits 48*gh* in the ground contact terminals 48Gbi. Note that the distance Lc and the distance Lb are respectively set to the same values as the separation distances Lc and Lb of the fixing pieces 28*gpi* on the ground contact plate 28GA described above.

Figure 15:
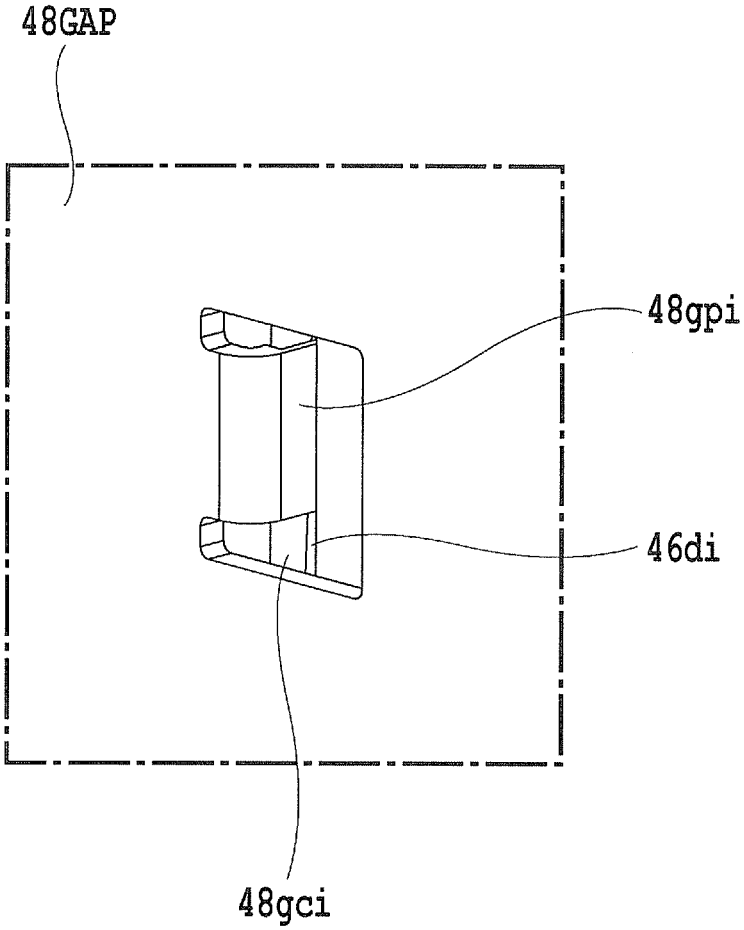
FIG. 15 is a partial enlarged view of a section A in FIG. 13.

As shown in the partial enlarged view of FIG. 15, the fixing pieces 48*gpi* are each bent toward the first surface portion 46A of the transmission blade 46 by press work in such a manner as to be perpendicular to the surface. Openings 48*gci* (i=1 to 20) are formed around the respective fixing pieces 48*gpi*. Tip ends of the respective fixing pieces 48*gpi* project through slits 46*di* (i=1 to 20) (see FIG. 15) formed in the transmission blade 46 so as to correspond to the respective fixing pieces 48*gpi*, and are located at enlarged portions 48*gpk* of the slits 48*gh* in the respective ground contact terminals 48Gbi. Then, the tip end of each of the fixing pieces 48*gpi* is fitted in a reduced portion 48*gaj* of each of the slits 48*gh* in the ground contact terminals 48Gbi as the ground contact plate 48GA slides further upward and is then press-fitted.

Herewith, the fixing piece 48*gpi* slidably abuts on the reduced portion 48*gaj* and gets wiped. Accordingly, an oxide layer or a foreign object at an fitted portion will be removed and stable electrical connection can reliably be obtained.

The conductive pattern on the printed circuit board 16, to which the fixation terminals portions 42Bi of the above-described transmission blade 46 are fixed, may be selected as appropriate depending on whether the system employs the transmission mode of the single end mode or the differential mode as similar to the conductive pattern on the printed circuit board 12. The conductive pattern on the printed circuit board 16 is formed similarly to the conductive pattern on the above-described printed circuit board 12.

In the above-described example, the number and intervals among the fixing pieces 28*gpi* of the ground contact plate 28GA in the contact unit 18Bi of the plug connector 10 respectively match the number and intervals among the fixing pieces 48*gpi* of the ground contact plate 48GA in the receptacle contact unit 38Bi. However, without limitation to this example, the number and intervals among the fixing pieces 28*gpi* of the ground contact plate 28GA in the contact unit 18Bi may be different from the number and intervals among the fixing pieces 48*gpi* of the ground contact plate 48GA in the receptacle contact unit 38Bi, for instance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A contact unit comprising:

a ground contact plate placed on a first surface portion of a transmission blade and having a plurality of fixation terminal portions to be fixed to a printed circuit board;

a transmission contact terminal group placed on a second surface portion of the transmission blade opposite from the first surface portion and having a plurality of pairs of transmission contact terminals each of which has a fixation terminal portion to be fixed to the printed circuit board and forms a signal transmission path; and a plurality of ground contact terminals each placed between the pairs of the transmission contact terminals adjacent to each other and having a fixation terminal portion to be fixed to the printed circuit board, wherein each of the ground contact terminals has at least one slit to be fitted with at least one fixing piece formed in the ground contact plate via the transmission blade, thereby making a frequency of a noise component occurring at the ground contact terminal become out of a frequency range of a signal transmitted to the signal transmission path.

2. The contact unit according to claim 1, wherein the slit in the ground contact terminal comprises an enlarged portion and a reduced portion continuous to the enlarged portion.

3. The contact unit according to claim 1, wherein a plurality of the fixing pieces are formed in a line at equal intervals in the ground contact plate, and a plurality of the slits are formed in a line at equal intervals in the ground contact terminal.

4. The contact unit according to claim 2, wherein a plurality of the fixing pieces are formed in a line at equal intervals in the ground contact plate, and a plurality of the slits are formed in a line at equal intervals in the ground contact terminal.

5. A printed circuit board connector comprising:

a contact unit including:

a ground contact plate placed on a first surface portion of a transmission blade, and having a plurality of fixation terminal portions to be fixed to a printed circuit board;

a transmission contact terminal group placed on a second surface portion of the transmission blade opposite with the first surface portion, and having a plurality of pairs of transmission contact terminals each of which has a fixation terminal portion to be fixed to the printed circuit board and forms a signal transmission path; and a plurality of ground contact terminals each placed between the pairs of the transmission contact terminals adjacent to each other and having a fixation terminal portion to be fixed to the printed circuit board; and a casing housing a plurality of the contact units, wherein each of the ground contact terminals in the contact unit has at least one slit to be fitted with at least one fixing piece formed in the ground contact plate via the transmission blade, thereby making a frequency of a noise component occurring at the ground contact terminal become out of a frequency range of a signal transmitted to the signal transmission path.

6. The printed circuit board connector according to claim 5, wherein the slit in the ground contact terminal comprises an enlarged portion and a reduced portion continuous to the enlarged portion.

7. The printed circuit board connector according to claim 5, wherein a plurality of the fixing pieces are formed in a line at equal intervals in the ground contact plate, and a plurality of the slits are formed in a line at equal intervals in the ground contact terminal.

8. The printed circuit board connector according to claim 5, wherein the fixation terminal portions of the ground contact plate are formed to cover an array of all the fixation terminal portions of the ground contact terminals and of the transmission contact terminal group.

9. The printed circuit board connector according to claim 6, wherein the fixation terminal portions of the ground contact plate are formed to cover an array of all the fixation terminal portions of the ground contact terminals and of the transmission contact terminal group.

10. The printed circuit board connector according to claim 5, wherein a projection piece connected to a flat surface portion of the ground contact plate is formed to cover an array of all the fixation terminal portions of the ground contact terminals and of the transmission contact terminal group.

11. The printed circuit board connector according to claim 6, wherein a projection piece connected to a flat surface portion of the ground contact plate is formed to cover an array of all the fixation terminal portions of the ground contact terminals and of the transmission contact terminal group.

* * * * *